US009152063B2

(12) United States Patent
Mang et al.

(10) Patent No.: US 9,152,063 B2
(45) Date of Patent: Oct. 6, 2015

(54) TONER WITH IMPROVED FUSING PERFORMANCE

(71) Applicant: Xerox Corporation, Norwalk, CT (US)

(72) Inventors: Mark E Mang, Rochester, NY (US); Juan A Morales-Tirado, Henrietta, NY (US); Tab A Tress, Henrietta, NY (US); Kevin F Marcell, Webster, NY (US); Brian J Andaya, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 201 days.

(21) Appl. No.: 13/928,766

(22) Filed: Jun. 27, 2013

(65) Prior Publication Data

US 2015/0004381 A1 Jan. 1, 2015

(51) Int. Cl.

| | |
|---|---|
| ***G03G 9/08*** | (2006.01) |
| ***G03G 7/00*** | (2006.01) |
| ***G03G 9/087*** | (2006.01) |
| ***G03G 9/097*** | (2006.01) |

(52) U.S. Cl.

CPC ..... *G03G 7/006* (2013.01); *G03G 9/08755* (2013.01); *G03G 9/08782* (2013.01); *G03G 9/08795* (2013.01); *G03G 9/08797* (2013.01); *G03G 9/0975* (2013.01); *Y10T 428/24901* (2015.01)

(58) Field of Classification Search

CPC ..... G03G 9/08782; G03G 9/08755
USPC ..... 430/108.8, 109.1, 109.4
See application file for complete search history.

(56) References Cited

U.S. PATENT DOCUMENTS

| | | | | |
|---|---|---|---|---|
| 7,887,982 | B2 | 2/2011 | Vijayendran et al. | |
| 2011/0195233 | A1 | 8/2011 | Vijayendran et al. | |
| 2014/0099575 | A1 * | 4/2014 | Mang et al. | 430/105 |

* cited by examiner

*Primary Examiner* — Mark A Chapman
(74) *Attorney, Agent, or Firm* — MDIP LLC

(57) ABSTRACT

The present disclosure provides a toner comprising a bioresin and two waxes with improved fuser release.

19 Claims, No Drawings

TONER WITH IMPROVED FUSING PERFORMANCE

FIELD

Toner with reduced levels of petroleum-based reagents and increased levels of biobased reagents, which improve fusing properties of the toner; devices comprising said toner; imaging device components comprising said toner; imaging devices comprising said toners; and so on, are described.

BACKGROUND

With an increased focus on environment and health, there is an interest and/or a need to find suitable reagent replacements of petroleum-based reagents of toner.

As is known in the electrophotographic process, during copying, an electrostatic latent image is formed on a photoreceptor made of photoconductive material, which latent image is transferred onto a receiving medium or substrate, such as, a paper or a sheet, and then the image is fused or fixed to the medium using, for example, heat, solvent or pressure.

Heat melting processes have been widely used for fixing transferred toner images and are classified largely into two processes: contact processes and non-contact processes. Contact processes are superior in thermal efficiency and thus allow high-speed fixing. However, heat-roll fixing processes have some drawbacks, such as, adhesion of the image to the photoreceptor and poor adhesion of toner on the medium.

One approach for addressing those shortcomings is to employ toner binder resin that, for example, has a lower glass transition temperature (Tg) to facilitate more rapid solidification. However, many such toilers have a drawback in aggregating or caking during storage or in an end user device. Also, such toners can adhere to the photoreceptor or to the fuser, called, "offset," where the toner particles are passed on to subsequent media.

Another approach is adhering fine particles, such as, colloidal silica, alumina or titania to the surface of toner particles for improvement in blocking resistance and flowability. However, the fine particles, even if subjected to heat treatment or the like for adhesion to the toner particle surface, often are released from the toner particle surface, negatively affecting the photoreceptor, in particular one having a surface coated with an organic polymer or the like.

Various waxes are used as a fixing aid in toner. However, the addition of too much wax will cause poor toner flow properties.

In a heat-roll fixing process, curling of a transfer medium, such as, paper, around a fixing or fusing roll after fixing can be prevented by a stripper finger placed in the fixing roll unit (heating unit). However, with the recent trend to higher speed copying machines, stress applied at that site process is larger, leading to more frequent image defects, such as, stripper finger artifacts present on an image.

Exfoliation or local detachment of the surface layer of fixing or fusing units due to inadequate release and excessive application of local stress, such as, toner or aberrant stripper finger operation, further causes fatal defects in the surface of the fixing units (heating unit and pressurizing unit) surface. For example, the surface layer of the heating unit is usually coated with a layer of polymer superior in release properties, such as, a silicone or fluorocarbon resin for prevention of toner particle adhesion. If that layer is damaged, toner components remain on the surface of the heating unit. That causes offset wherein toner is retransferred onto an unintended printing face.

Hence, there remains a need to obtain toner with good fusing performance to enable, for example, faster printing speeds. There also is a need to have toner that is more environmentally friendly.

SUMMARY

The instant disclosure provides a biobased toner that comprises good fusing performance, such as, superior minimal interaction with stripper finger operation. The toner of interest can comprise a polypropylene wax, a bioresin, a negative charge control agent, an amorphous polyester resin, a carnauba wax and optionally, a colorant.

DETAILED DESCRIPTION

Proper release of a fused image from a hot fuser roll is a balancing act of release and adhesion characteristics of the toner. Molten toner becomes sticky, like a tar. Often wax is added to the toner formulation to assist with the release process. An added challenge arises when prints have a large, solid darker, such as, black, printed area, such as, an image of a wide black stripe, or a graphic item, such as, a picture or shape that comprises a dark color or comprises portions with dark coloration, or any image where the aggregate toner is applied to the substrate at a high TMA, toner mass area. That causes those portions of the print surface to have a sticky, tar-like surface that can be difficult to remove from the fuser roll. Such dark or toner-rich regions also present a challenge for the stripper fingers since the fingers tend to dig into the molten toner rather than to slide over the toner.

Those toner properties and the interaction thereof with the fuser apparatus can result in a paper jam in the fuser, an image that has objectionable streaks across the page and/or image imperfections in subsequent receiving media.

The present disclosure provides a toner which replaces a proportion of a petroleum-based reagent with a biobased reagent with improved fuser release, for example, relative to a toner of similar formulation but not containing the biobased reagent.

Unless otherwise indicated, all numbers expressing quantities and conditions, and so forth used in the specification and claims are to be understood as being modified in all instances by the term, "about." "About," meant to indicate a variation of no more than 10% from the stated value, which values used herein are known, and how to obtain such values are known, practicing methods known in the art. Also used herein is the term, "equivalent," "similar," "essentially," "substantially," "approximating," and "matching," or grammatical variations thereof, have generally acceptable definitions or at the least, are understood to have the same meaning as, "about."

As used herein, "biobased," or use of the prefix, "bio," means a product that is composed of or obtained from, in whole or in part, a biological product, including plant, animal and marine materials. Generally, a biobased material is biodegradable, that is, substantially or completely biodegradable, by substantially is meant greater than 50%, greater than 60%, greater than 70% or more of the material is degraded from the original molecule to another form by a biological or environmental mechanism, such as, action thereon by bacteria, animals, plants and so on in a matter of days, matter of weeks, a year or more, but generally no longer than two years. A, "biotoner," is one which contains or is composed of a biobased material, such as, a bioresin, and is biodegradable.

By, "good fuser release," is meant that the toner demonstrates good fusing performance by minimizing offset. There are several metrics that can be used to assess good fusing performance. For example, good release or stripping performance can be defined in terms of an imaged substrate that separates from a fuser roll surface without requiring support of stripping components beyond the initial lead edge. Alternatively, low offset or VNO (Non-Visual Offset) can be measured by monitoring fuser web contamination. Toner particles that remain adhered to a fuser roll during the stripping process can be partially collected on the fuser roll cleaning web. That contamination can be measurable directly on the web using, for example, densitometry, with higher density relating to greater NVO, that is, poorer release. Increasing web contamination also relates to elevation in MOC (Marks On Copy) in which the elevated NVO web contamination retransfers back to the fuser roll between run cycles and subsequently is transferred to a substrate, that is, substrate units subsequent to the image cycle, and the contamination is transferred, undesirably, to subsequent units of substrate. The toner particle is one which does not adhere too strongly and which attaches well and substantially completely to a substrate, such as, a paper, on transfer during the electrophotographic process. A measure of good toner fuser release is a reduction of stripper finger defects in an image on a substrate. If the fused substrate adheres too firmly to the fuser roll the stripper fingers tend to dig into the molten toner surface.

The term, "improved stripping performance," relates to the characteristics of an image using a biotoner of interest and is complimentary to good fuser release. In embodiments, a good fuser release metric is to assess stripper finger defects in the image on a substrate. A stripper finger defect as defined as the measured length in millimeters of the visible defect, such as, a line of partially or totally removed toner, or a line of differential gloss due to the stripper finger, in a darker area of the document. In embodiments, the defect length of a toner with good fuser release, using a TMA of about 0.7 g/cm$^2$, is less than about 40 mm, less than about 30 mm, less than about 20 mm, less than about 10 mm.

1. Toner Particles

Toner particles comprise a resin and may include other optional reagents, such as, a colorant, a surfactant, a wax, a shell and so on. A toner of interest comprises a bioresin and two waxes. The shell can be composed of any resin taught herein or as known in the art. The toner composition optionally may comprise inert particles, which may serve as toner particle carriers, which may comprise the resin taught herein. The inert particles may be modified, for example, to serve a particular function. Hence, the surface thereof may be derivatized or the particles may be manufactured for a desired purpose, for example, to carry a charge or to possess a magnetic field.

A. Components

1. Resin

Toner particles of the instant disclosure comprise a resin that can be made from any polyfunctional monomer as known in the art. For example, in the case of a polyester, suitable polyacids/polyesters and polyols can be used in an esterification reaction to form particular polyester polymers for making toner.

Two or more polymers may be used in forming a toner or toner particle. In embodiments where two or more polymers are used, the polymers may be in any suitable ratio (e.g., weight ratio) such as, for instance, with two different polymers, from about 1% (first polymer)/99% (second polymer) to about 99% (first polymer)/1% (second polymer), from about 10% (first polymer)/90% (second polymer) to about 90% (first polymer)/10% (second polymer) and so on, as a design choice.

The two or more polymers, including a bioresin, in aggregate, may be present in an amount of from about 65 to about 98% by weight, from about 75 to about 95% by weight of toner particles on a solids basis. For example, resin can comprise up to 90%, up to 95% of a toner particle on a weight basis, such as, about 90%, about 91%, about 92%, about 93%, about 94%, about 95%, about 96% and so on of a toner particle. As that total amount is divided between a traditional, petroleum-based resin and a bioresin, a bioresin can comprise up to 40% by weight of a toner, up to 50%, up to 60% by weight of a toner or more, such as, about 40%, about 41%, about 42%, about 43%, about 44%, about 45%, about 46%, about 47%, about 48%, about 49%, about 50%, about 51% by weight of a toner can be comprised of a bioresin, with the remainder comprised of one or more traditional, petroleum-based resins in amounts, such as, up to 40 wt %, up to 50 wt %, up to 60 wt % or more, as a design choice.

a. Polyester Resins

Suitable polyester resins include, for example, those which are sulfonated, non-sulfonated, amorphous, combinations thereof and the like. The polyester resins may be linear, branched, crosslinked, combinations thereof and the like. Polyester resins may include those described, for example, in U.S. Pat. Nos. 6,593,049; 6,830,860; 7,754,406; 7,781,138; 7,749,672; and 6,756,176, the disclosure of each of which hereby is incorporated by reference in entirety.

Examples of polyols which may be used in generating an amorphous polyester resin include 1,2-propanediol, 1,3-propanediol, 1,2-butanediol 1,3-butanediol, 1,4-butanediol, pentanediol, hexanediol, 2,2-dimethylpropanediol, 2,2,3-trimethylhexanediol, heptanediol, dodecanediol, 1,4-cyclohexanedimethanol, 1,3-cyclohexanedimethanol, xylenedimethanol cyclohexanediol, diethylene glycol, bis(2-hydroxyethyl)oxide, dipropylene glycol, dibutylene glycol, and combinations thereof. The amount of polyol may vary, and may be present, for example, in an amount from about 40 to about 60 mole % of the resin, from about 42 to about 55 mole % of the resin, from about 45 to about 53 mole % of the resin.

Examples of polyacids or polyesters that can be used to make an amorphous resin include terephthalic acid, phthalic acid, isophthalic acid, fumaric acid, trimellitic acid, dimethyl itaconate, cis 1,4-diacetoxy-2-butene, dimethyl fumarate, diethyl maleate, diethyl fumarate, maleic acid, succinic acid, itaconic acid, succinic acid, cyclohexanoic acid, succinic anhydride, dodecylsuccinic acid, dodecylsuccinic anhydride, glutaric acid, glutaric anhydride, adipic acid, pimelic acid, suberic acid, azelaic acid, dodecanedioic acid, dimethyl naphthalenedicarboxylate, dimethyl terephthalate, diethyl terephthalate, dimethylisophthalate, diethylisophthalate, dimethylphthalate, phthalic anhydride, diethylphthalate, dimethylsuccinate, naphthalene dicarboxylic acid, dimer diacid, dimethylfumarate, dimethylmaleate, dimethylglutarate, dimethyladipate, dimethyl dodecylsuccinate and combinations thereof.

In embodiments, an unsaturated amorphous polyester resin may be used as a latex resin. Examples of such resins include those disclosed in U.S. Pat. No. 6,063,827, the disclosure of which is hereby incorporated by reference in entirety. Exemplary unsaturated amorphous polyester resins include, but are not limited to, poly(1,2-propylene fumarate), poly(1,2-propylene itaconate) and combinations thereof.

Examples of amorphous resins which may be used include alkali sulfonated-polyester resins, branched alkali sulfonated-polyester resins, alkali sulfonated-polyimide resins and branched alkali sulfonated-polyimide resins. Alkali sulfonated polyester resins may be useful in embodiments, such as, the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)copoly(diethylene-5-sulfo-isophthalate), copoly(propylene-diethylene-terephthalate)-copoly(propylene-diethylene-5-sulfoisophthalate) and copoly(propylene-butylene-terephthalate)-copoly(propylene-butylene-5-sulfo-isophthalate), wherein the alkali metal is, for example, a sodium, a lithium or a potassium ion.

Examples of other suitable resins or polymers which may be utilized in forming a toner include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-ioprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), and combinations thereof. The polymer may be, for example, block, random or alternating copolymers.

The Tg of an amorphous polyester resin can be from about 55° C. to about 67° C., from about 57° C. to about 65° C., from about 59° C. to about 63° C., for example.

An example of an amorphous resin is a polyester produced from about a 50:50 mixture of polyalcohol and polyacid. On a molar basis, the polyalcohol is about 75% propoxylated bisphenol-A and 25% ethoxylated bisphenol-A. On a molar basis the polyacid is about 80% terephthalic acid, 10% dodecylsuccinic acid and 10% trimellitic acid. That resin has an onset Tg of about 61.5±2.5° C. and an endset Tg about 8° C. higher than the onset temperature.

b. Bioresin

One approach to obtaining a bioresin relies on obtaining dimer acid or dimer diol from soy oil, and other necessary reagents from other renewable sources, such as, isosorbide from corn, see for example US Publ. No. 20110195233.

The Tg of a bioresin can be from about 50° C. to about 62° C., from about 52° C. to about 60° C., from about 54° C. to about 58° C., for example.

An example of a bioderived amorphous polyester is described in U.S. Pat. No. 7,887,982, herein incorporated by reference in entirety, as noted in Table 2B and described further in Example 3. Up to 10% crosslinking agents, such as, trimethylpropane, may be added to adjust the rheology as needed. Any suitable dimer acid may be used. For example, the dimer acid may be obtained from cotton seeds. For that particular resin, the Tg is about 56° C.

A bioresin can replace all or a part of the petroleum-based resin of a toner. Hence, the amount of bioresin can be from about 1% to 100% of the total amount of resin present in a toner.

c. Catalyst

Condensation catalysts which may be used in the polyester reaction include tetraalkyl titanates; dialkyltin oxides, such as, dibutyltin oxide; tetraalkyltins, such as, dibutyltin dilaurate; dibutyltin diacetate; dialkyltin oxide hydroxides, such as, butyltin oxide hydroxide; aluminum alkoxides, alkyl zinc, dialkyl zinc, zinc oxide, stannous oxide, stannous chloride or combinations thereof. In embodiments, such catalysts may include butylstannoic acid (Fascat 4100®) and dibutyltin oxide (Fascat 4201®), Arkema Inc., Philadelphia, Pa.

Such catalysts may be used in amounts of, for example, from about 0.01 mole % to about 5 mole % based on the amount of starting polyacid, polyol or polyester reagent in the reaction mixture.

Generally, as known in the art, the polyacid/polyester and the polyol are mixed, optionally with a catalyst, and incubated at an elevated temperature, such as, from about 180° C. or more, from about 190° C. or more, from about 200° C. or more, and so on, which may be conducted anaerobically, to enable esterification to occur until equilibrium, which generally yields water or an alcohol, such as, methanol, arising from forming the ester bonds in esterification reactions. The reaction may be conducted under vacuum to promote polymerization. The product is collected by practicing known methods, and may be dried, again, by practicing known methods to yield particulates.

d. Initiator

In embodiments, the resin may be a crosslinkable resin. A crosslinkable resin is a resin, for example, including a crosslinkable group or groups, such as, a C═C bond, or a pendant group or side group, such as, a carboxylic acid group. The resin may be crosslinked, for example, through a free radical polymerization with an initiator.

Suitable initiators include peroxides, such as, organic peroxides or azo compounds, for example, diacyl peroxides, ketone peroxides, alkyl peroxy esters, alkyl peroxides, alkyl hydroperoxides, alkyl peroxyketals, combinations thereof and the like. The amount of initiator used generally is proportional to the degree of crosslinking, and thus, the gel content of the polyester material. The amount of initiator used may range from, for example, about 0.01 to about 10 weight % of the polyester resin. In the crosslinking, it is desirable that substantially all of the initiator be consumed. The crosslinking may be carried out at high temperature and thus, the reaction may be from about 20 seconds to about 2 minutes residence time.

2. Colorants

Suitable colorants include those comprising carbon black, such as, REGAL 330® (or R330, Cabot, Alpharetta, Ga.) and Nipex 35; magnetites, such as, Mobay magnetites, MO8029™ and MO8060™; Columbian magnetites, MAPICO® BLACK; surface-treated magnetites; Pfizer magnetites, CB4799™, CB5300™, CB5600™ and MCX6369™; Bayer magnetites, BAYFERROX 8600™ and 8610™; Northern Pigments magnetites, NP-604™ and NP-608™; Magnox magnetites, TMB-100™ or TMB-104™; and the like.

Colored pigments, such as, cyan, magenta, yellow, red, orange, green, brown, blue or mixtures thereof may be used. The additional pigment or pigments may be used as water-based pigment dispersions.

Examples of pigments include SUNSPERSE 6000, FLEXIVERSE and AQUATONE, water-based pigment dispersions from SUN Chemicals; HELIOGEN BLUE L6900™, D6840™, D7080™, D7020™, PYLAM OIL BLUE™, PYLAM OIL YELLOW™ and PIGMENT BLUE 1™ available from Paul Uhlich & Company, Inc.; PIGMENT VIOLET 1™, PIGMENT RED 48™, LEMON CHROME YELLOW DCC IO26™, TOLUIDINE RED™ and BON RED C™ available from Dominion Color Corporation, Ltd., Toronto, Ontario; NOVAPERM YELLOW FGL™ and HOS- TAPERM PINK E™ from Hoechst; CINQUASIA MAGENTA™ available from E.I. DuPont de Nemours & Co. and the like.

Examples of magenta pigments include 2,9-dimethyl-substituted quinacridone, an anthraquinone dye identified in the Color Index (CI) as CI 60710, CI Dispersed Red 15, a diazo dye identified in the Color Index as CI 26050, CI Solvent Red 19 and the like.

Illustrative examples of cyan pigments include copper tetra (octadecylsulfonamido) phthalocyanine, a copper phthalocyanine pigment listed in the Color Index as CI 74160, CI Pigment Blue, Pigment Blue 15:3, Pigment Blue 15:4, an Anthrazine Blue identified in the Color Index as CI 69810, Special Blue X-2137 and the like.

Illustrative examples of yellow pigments are diarylide yellow 3,3-dichlorobenzidene acetoacetanilide, a monoazo pigment identified in the Color Index as CI 12700, CI Solvent Yellow 16, a nitrophenyl amine sulfonamide identified in the Color Index as Foron Yellow SE/GLN, CI Disperse Yellow 3, 2,5-dimethoxy-4-sulfonanilide phenylazo-4'-chloro-2,5-dimethoxy acetoacetanilide and Permanent Yellow FGL.

Other known colorants may be used such as, Levanyl Black A-SF (Miles, Bayer) and Sunsperse Carbon Black LHD 9303 (Sun Chemicals), and colored dyes, such as, Neopen Blue (BASF), Sudan Blue OS (BASF), PV Fast Blue B2G 01 (American Hoechst), Sunsperse Blue BHD 6000 (Sun Chemicals), Irgalite Blue BCA (CibaGeigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF) SUCD-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like. Other pigments that may be used, and which are commercially available include various pigments in the color classes, Pigment Yellow 74, Pigment Yellow 14, Pigment Yellow 83, Pigment Orange 34, Pigment Red 238, Pigment Red 122, Pigment Red 48:1, Pigment Red 269, Pigment Red 53:1, Pigment Red 57:1, Pigment Red 83:1, Pigment Violet 23, Pigment Green 7 and so on, and combinations thereof.

The colorant, for example, carbon black, cyan, magenta and/or yellow colorant, may be incorporated in an amount sufficient to impart the desired color to the toner. Pigment or dye, may be employed in an amount ranging from about 0% (for a clear toner) to about 35% by weight of the toner particles on a solids basis, from about 1% to about 25% by weight, from about 2% to about 15% by weight, such as, 4 wt %, 4.25 wt %, 4.5 wt %, 4.75 wt %, 5 wt % and so on.

In embodiments, more than one colorant may be present in a toner particle. For example, two colorants may be present in a toner particle, such as, a first colorant of a blue, may be present in an amount ranging from about 2% to about 10% by weight of the toner particle on a solids basis, from about 3% to about 8% by weight; from about 5% to about 10% by weight; with a second colorant of a black that may be present in an amount ranging from about 5% to about 20% by weight of the toner particle on a solids basis, from about 6% to about 15% by weight, from about 10% to about 20% by weight and so on.

3. Optional Components a. Surfactants

In embodiments, toner compositions may be in dispersions including surfactants. One, two or more surfactants may be used. The surfactants may be selected from ionic surfactants and nonionic surfactants, or combinations thereof. Anionic surfactants and cationic surfactants are encompassed by the term, "ionic surfactants."

The surfactant(s) may be used in an amount of from about 0.01% to about 5% by weight of the toner-forming composition, from about 0.75% to about 4% by weight of the toner-forming composition, from about 1% to about 3% by weight of the toner-forming composition.

Examples of nonionic surfactants include, for example, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether and dialkylphenoxy poly(ethyleneoxy) ethanol, for example, available from Rhone-Poulenc as IGEPAL CA-210™, IGEPAL CA-520™, IGEPAL CA-720™, IGEPAL CO-890™, IGEPAL, CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC® PR/F, in embodiments, SYNPERONIC® PR/F 108; and a DOWFAX, available from The Dow Chemical Corp.

Anionic surfactants include sulfates and sulfonates, such as, sodium dodecylsulfate (SDS), sodium dodecylbenzene sulfonate, sodium dodecylnaphthalene sulfate and so on; dialkyl benzenealkyl sulfates; acids, such as, palmitic acid, and NEOGEN or NEOGEN SC obtained from Daiichi Kogyo Seiyaku, and so on, combinations thereof and the like. Other suitable anionic surfactants include, in embodiments, alkyldiphenyloxide disulfonates or TAYCA POWER BN2060 from Tayca Corporation (Japan), which is a branched sodium dodecyl benzene sulfonate. Combinations of those surfactants and any of the foregoing nonionic surfactants may be used in embodiments.

Examples of cationic surfactants include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, trimethyl ammonium bromides, halide salts of quarternized polyoxyethylalkylamines, dodecylbenzyl triethyl ammonium chlorides, MIRAPOL® and ALKAQUAT® available from Alkaril Chemical Company, SANISOL® (benzalkonium chloride) available from Kao Chemicals and the like, and mixtures thereof, including, for example, a nonionic surfactant as known in the art or provided hereinabove.

b. Waxes

The toners of the instant disclosure contain a mixture of two or more different types of waxes (hereinafter identified as "a wax"). The wax may be present in an amount of, for example, from about 0.5 wt % to about 10 wt % of the toner particles, from about 1 wt % to about 5 wt % of the toner particles, such as, 2,3 wt %, 2.5 wt %, 2.7 wt %, 2.9 wt % or 3.1 wt %.

Waxes that may be selected include waxes having, for example, an Mw of from about 500 to about 20,000, from about 1,000 to about 10,000. Waxes that may be used include, for example, polyolefins, such as, polyethylene, polypropylene and polybutene waxes, such as, those that are commercially available, for example, POLYWAX™ polyethylene waxes from Baker Petrolite, wax emulsions available from Michaelman, Inc. or Daniels Products Co., EPOLENE N15™ which is commercially available from Eastman Chemical Products, Inc., VISCOL 550P™, a low weight average molecular weight polypropylene available from Sanyo Kasei K.K.; plant-based waxes, such as carnauba wax, rice wax, candelilla wax, sumac wax and jojoba oil; animal-based waxes, such as beeswax; mineral-based waxes and petroleum-based waxes, such as montan wax, ozokerite, ceresin wax, paraffin wax, microcrystalline wax and Fischer-Tropsch waxes; ester waxes obtained from higher fatty acids and higher alcohols, such as stearyl stearate and behenyl behenate; ester waxes obtained from higher fatty acids and monovalent or multivalent lower alcohols, such as butyl stearate, propyl oleate, glyceride monostearate, glyceride distearate and pentaerythritol tetrabehenate; ester waxes obtained from higher fatty acids and multivalent alcohol multimers, such as diethyleneglycol monostearate, dipropyleneglycol distearate, diglyceryl distearate and triglyceryl tetrastearate; sorbitan higher fatty acid ester waxes, such as sorbitan monostearate; cholesterol higher fatty acid ester waxes, such as, cholesteryl stearate, and so on.

Mixtures and combinations of the foregoing waxes also may be used in embodiments. For example, a polypropylene was and a plant-based wax can be combined, such as, a carnauba wax. The amount of polypropylene wax can be from about 1.5 to about 2.1 wt %, from about 1.6 to about 2 wt %, from about 1.7 to about 1.9 wt % of the toner and the carnauba wax can be present in amounts from about 0.6 to about 1.3 wt %, from about 0.7 to about 1.1 wt %, from about 0.8 to about 1 wt % of the toner particle.

c. Charge Additives

The toner may include any known charge control additives, such as, alkyl pyridinium halides, bisulfates, the charge control additives of U.S. Pat. Nos. 3,944,493; 4,007,293; 4,079,014; 4,394,430; and 4,560,635, the disclosure of each of which hereby is incorporated by reference in entirety, negative charge enhancing additives, such as, aluminum complexes, and the like.

Charge enhancing molecules may be used to impart either a positive or a negative charge on a toner particle. Examples include quaternary ammonium compounds, see, for example, U.S. Pat. No. 4,298,672, organic sulfate and sulfonate compounds, see for example, U.S. Pat. No. 4,338,390, cetyl pyridinium tetrafluoroborates azo compounds, such as, BONTRON S-34 which is a negative charge control additive (Orient Chemical, Kenilworth, N.J.), distearyl dimethyl ammonium methyl sulfate, aluminum salts and so on.

Such enhancing molecules may be present in an amount of from about 0.1 to about 10%, from about 0.5 to about 3% by weight, such as about 0.6 wt %, about 0.7 wt %, about 0.8 wt %, about 0.9 wt %, about 1 wt % of the toner particle.

d. Optional Additives

In embodiments, the toner particles also may contain other optional additives.

i. Surface Modifications

Surface additives may be added to the toner compositions of the present disclosure, for example, after washing or drying. Examples of such surface additives include, for example, one or more of a metal salt, a metal salt of a fatty acid, a colloidal silica, a metal oxide, such as, $TiO_2$ (for example, for improved RH stability, tribo control and improved development and transfer stability), an aluminum oxide, a cerium oxide, a strontium titanate, $SiO_2$, mixtures thereof and the like. Examples of such additives include those disclosed in U.S. Pat. Nos. 3,590,000; 3,720,617; 3,655,374; and 3,983,045, the disclosure of each of which hereby is incorporated by reference in entirety.

Surface additives may be used in an amount of from about 0.1 to about 10 wt %, from about 0.5 to about 7 wt % of the toner.

Other surface additives include lubricants, such as, a metal salt of a fatty acid (e.g., zinc or calcium stearate) or long chain alcohols, such as UNILIN 700 available from Baker Petrolite and AEROSIL R972® available from Degussa. The coated silicas of U.S. Pat. Nos. 6,190,815 and 6,004,714, the disclosure of each of which hereby is incorporated by reference in entirety, also may be present. The additive may be present in an amount of from about 0.05 to about 5%, from about 0.1 to about 2% of the toner, which additives may be added during the aggregation or blended into the formed toner product.

Hence, a particle may contain at the surface one or more silicas, one or more metal oxides, such as, a titanium oxide and a cerium oxide, a lubricant, such as, a zinc stearate and so on. In embodiments, a particle surface may comprise two silicas, two metal oxides, such as, titanium oxide and cerium oxide, and a lubricant, such as, a zinc stearate. All of those surface components may comprise about 5% by weight of a toner particle weight. There may also be blended with the toner compositions, external additive particles including flow aid additives, which additives may be present on the surface of the toner particles. Examples of these additives include metal oxides like titanium oxide, tin oxide, mixtures thereof, and the like; colloidal silicas, such as AEROSIL®, metal salts and metal salts of fatty acids, including zinc stearate, aluminum oxides, cerium oxides and mixtures thereof. Each of the external additives may be present in embodiments in amounts of from about 0.1 to about 5 wt %, from about 0.1 to about 1 wt %, of the toner. Several of the aforementioned additives are illustrated in U.S. Pat. Nos. 3,590,000, 3,800,588, and 6,214,507, the disclosure of each of which is incorporated herein by reference.

B. Toner Particle Preparation

1. Method

The bioresin and the petroleum-derived resin can be melt blended or mixed in an extruder with other ingredients, such as, waxes, pigments/colorants, internal charge control agents, pigment dispersants, flow additives, embrittling agents, wax and the like to form a toner mixture. The resultant product then can be micronized by known methods, such as, milling or grinding, and then classified to form the desired toner particles.

The dry toner particles, exclusive of external surface additives, may have: (1) a volume average diameter (also referred to as "volume average particle diameter") of from about 2.5 to about 20 μm, from about 2.75 to about 10 μm, from about 3.7 to about 7.5 μm. The toner may have a Tg from about 55° C. to about 65° C., such as, about 55° C., about 57° C. about 59° C., about 61° C. about 63° C. about 65° C.

III. Developers

A. Composition

The toner particles thus formed may be formulated into a developer composition. For example, the toner particles may be mixed with carrier particles to achieve a two component developer composition. The toner concentration in the developer may be from about 1% to about 25% by weight of the total weight of the developer, from about 2% to about 15% by weight of the total weight of the developer, with the remainder of the developer composition being the carrier. However, different toner and carrier percentages may be used to achieve a developer composition with desired characteristics.

1. Carrier

Examples of carrier particles for mixing with the toner particles include those particles that are capable of triboelectrically obtaining a charge of polarity opposite to that of the toner particles, illustrative examples of suitable carrier particles include granular zircon, granular silicon, glass, steel, nickel, ferrites, iron ferrites, silicon dioxide, one or more polymers and the like. Other carriers include those disclosed in U.S. Pat. Nos. 3,847,604; 4,937,166; and 4,935,326.

In embodiments, the carrier particles may include a core with a coating thereover, which may be formed from a polymer or a mixture of polymers that are not in close proximity thereto in the triboelectric series, such as, those as taught herein or as known in the art. The coating may include fluoropolymers, such as, polyvinylidene fluorides, terpolymers of styrene, methyl methacrylates, silanes, such as triethoxy silanes, tetrafluoroethylenes, other known coatings and the like. For example, coatings containing polyvinylidenefluoride, available, for example, as KYNAR 301F™, and/or polymethylmethacrylate (PMMA), for example, having a weight average molecular weight of about 300,000 to about 350,000, such as, commercially available from Soken, may be used. In embodiments, PMMA and polyvinylidenefluoride may be mixed in proportions of from about 30 to about 70 wt % to about 70 to about 30 wt %, from about 40 to about 60 wt % to about 60 to about 40 wt %. The coating may have a coating weight of, for example, from about 0.1 to about 5% by weight of the carrier, from about 0.5 to about 2% by weight of the carrier.

Various effective suitable means may be used to apply the polymer to the surface of the carrier core, for example, cascade roll mixing, tumbling, milling, shaking, electrostatic powder cloud spraying, fluidized bed mixing, electrostatic disc processing, electrostatic curtain processing, combinations thereof and the like. The mixture of carrier core particles and polymer then may be heated to enable the polymer to melt and to fuse to the carrier core. The coated carrier particles then may be cooled and thereafter classified to a desired particle size.

The carrier particles may be prepared by mixing the carrier core with polymer in an amount from about 0.05 to about 10% by weight, from about 0.01 to about 3% by weight, based on the weight of the coated carrier particle, until adherence thereof to the carrier core is obtained, for example, by mechanical impaction and/or electrostatic attraction.

In embodiments, suitable carriers may include a steel core, for example, of from about 25 to about 100 μm in size, from about 50 to about 75 μm in size, coated with about 0.5% to about 10% by weight, from about 0.7% to about 5% by weight of a polymer mixture including, for example, methylacrylate and carbon black, using the process described, for example, in U.S. Pat. Nos. 5,236,629 and 5,330,874.

IV. Devices Comprising a Toner Particle

Toners and developers may be combined with a number of devices ranging from enclosures or vessels, such as, a vial, a bottle, a flexible container, such as a bag or a package, and so on, to devices that serve more than a storage function.

A. Imaging Device Components

The toner compositions and developers of interest may be incorporated into devices dedicated, for example, to delivering same for a purpose, such as, forming, an image. Hence, particularized toner delivery devices are known, see, for example, U.S. Pat. No. 7,822,370, and may contain a toner preparation or developer of interest. Such devices include cartridges, tanks, reservoirs and the like, and may be replaceable, disposable or reusable. Such a device may comprise a storage portion; a dispensing or delivery portion; and so on; along with various ports or openings to enable toner or developer addition to and removal from the device; an optional portion for monitoring amount of toner or developer in the device; formed or shaped portions to enable siting and seating of the device in, for example, an imaging device; and so on.

B. Toner or Developer Delivery Device

A toner or developer of interest may be included in a device dedicated to delivery thereof, for example, for recharging or refilling toner or developer in an imaging device component, such as, a cartridge, in need of toner or developer, see, for example, U.S. Pat. No. 7,817,944, wherein the imaging device component may be replaceable or reusable.

V. Imaging Devices

The toners or developers may be used for electrostatographic or electrophotographic processes, including those disclosed in U.S. Pat. No. 4,295,990, the disclosure of which hereby is incorporated by reference in entirety. In embodiments, any known type of image development system may be used in an image developing device, including, for example, magnetic brush development, jumping single component development, hybrid scavengeless development (HSD) and the like. Those and similar development systems are within the purview of those skilled in the art.

Color printers commonly use four housings carrying different colors to generate full color images based on black plus the standard printing colors, cyan, magenta and yellow. However, in embodiments, additional housings may be desirable, including image generating devices possessing five housings, six housings or more, thereby providing the ability to carry additional toner colors to print an extended range of colors (extended gamut).

The latent images are transferred to a substrate and fused to the substrate. Suitable substrates include a paper, a plastic or other flat surface.

The following Examples illustrate embodiments of the instant disclosure. The Examples are intended to be illustrative only and are not intended to limit the scope of the present disclosure. Parts and percentages are by weight unless otherwise indicated.

EXAMPLES

Two toners were made, a control which represents a known toner and an experimental toner which replaces as portion of the resin of the control toner with a bioresin, see Table 1. 550P is a wax from Sanyo Kasei KK; BONTRON S-34 is a charge control agent from Orient Corp. (Kenilworth, N.J.); and R330 is a carbon black from Cabot Corp. The toners were made practicing melt mixing methods known in the art.

Resin A is the petroleum-based resin produced from about a 50:50 mixture of polyalcohol and polyacid. On a molar basis, the polyalcohol is about 75% propoxylated bisphenol-A and 25% ethoxylated bisphenol-A. On a molar basis, the polyacid is about 80% terephthalic acid, 10% dodecylsuccinic acid, and 10% trimellitic acid. The resin has an onset Tg of about 61.5±5° C. and an endset Tg value about 8° C. higher than the onset.

Resin B is a bioderived resin with about 50% biocontent based on $C^{14}$ analysis (ASTM D6866). The formulation of the bioderived amorphous polyester is described in U.S. Pat. No. 7,887,982, Table 2B, Example 3. Up to 10% crosslinking agents, such as trimethylpropane, may be added to adjust the rheology as needed. The Tg of the resin was about 56° C.

TABLE 1

Toner formulations

| Component | Control (% Wt) | Bio (% Wt) |
|---|---|---|
| 550P WAX | 1.8 | 1.8 |
| Resin B | 0 | 43 |
| BONTRON S-34 | 0.7 | 0.7 |
| CARNAUBA WAX | 0.9 | 0.9 |
| Resin A | 91.85 | 48.85 |
| R330 | 4.75 | 4.75 |

For performance testing, a nominal toner mass area (TMA) was used representing a usual amount of 0.7 g/cm$^2$ and a higher TMA of 0.8 g/cm$^2$ was used as a stress case to produce a thicker layer of toner. When a thicker layer of toner is melted in the fuser, the stripper fingers are more likely to dig into that thicker layer of toner.

Images were produced using the two toners at the two TMA amounts and the stripper finger interaction with the images as revealed by imperfections in the images was measured. At both TMA levels, the stripper finger lengths of the toner comprising bioresin were about 75% shorter than the scars noted in the images produced with the toner not containing bioresin. Table 2 shows the lengths of the stripper finger marks. The length of the marks represents the actual measurement in millimeters of the defect. An average value was determined averaging the values of all the marks on a page.

TABLE 2

Stripper finger length by toner type

| Toner | 0.7 TMA Stripper Finger Average Length (mm) | 0.8 TMA Stripper Finger Average Length (mm) |
|---|---|---|
| Control | 45 | 55 |
| Experimental | 10 | 20 |

Addition of bioresin had no adverse effect on cold offset or hot offset. Cold offset is when the fuser is at a relatively low temperature and the toner does not flow into the substrate and partially remains on the surface of the fuser roll. Hot offset is when the fuser roll is too hot for the properties of the toner and it becomes too sticky and partially remains on the surface of the fuser roll. Offset is determined by visual assessment, such as, looking at the fuser roll or smeared toner in non-image areas. The data presented in Table 3 show the toner with partial biocontent is equally robust to variation in the fuser roll temperature as is the fully petroleum based toner. The nominal fuser temperature was 195° C. and prints were made at a TMA of 0.7 g/cm$^2$.

TABLE 3

Offset latitude for a range of fuser temperatures

| Toner | Cold Offset ° C. | Hot Offset ° C. |
|---|---|---|
| Control | 145 | 225 |
| Experimental | 145 | 225 |

It will be appreciated that various of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

All references cited herein are herein incorporated by reference in entirety.

We claim:

1. A toner particle comprising:

a) a polypropylene wax;

b) a bioresin;

c) a negative charge control additive;

d) an amorphous polyester resin;

e) a carnauba wax; and f) a colorant.

2. The toner particle of claim 1, wherein said colorant comprises a black colorant.

3. The toner particle of claim 1, wherein said bioresin comprises about 40 weight % of said toner particle.

4. The toner particle of claim 1, wherein said polypropylene wax comprises about 2 wt % of said toner particle.

5. The toner particle of claim 1, wherein said negative charge control additive comprises about 1 wt % of said toner particle.

6. The toner particle of claim 1, wherein said amorphous polyester resin comprises about 50 wt % of said toner particle.

7. The toner particle of claim 1, wherein said colorant comprises about 5 wt % of said toner particle.

8. The toner particle of claim 1, wherein said carnauba wax comprises about 1 wt % of said toner particle.

9. The toner particle of claim 1, wherein said amorphous polyester resin comprises a $T_g$ from about 55° C. to about 67° C.

10. The toner particle of claim 1, wherein said amorphous polyester resin comprises $T_g$ of about 61° C.

11. The toner particle of claim 1, wherein said bioresin comprises a $T_g$ from about 50° C. to about 62° C.

12. The toner particle of claim 1, wherein said bioresin comprises a $T_g$ of about 56° C.

13. The toner particle of claim 1, comprising good fuser release.

14. A substrate comprising an image comprising the toner particle of claim 1, wherein said image comprises improved stripping performance.

15. The substrate of claim 14, comprising a paper.

16. The substrate of claim 14, wherein said improved stripping performance comprises reduced number of lines of partially or removed toner on said substrate, lines of differential gloss on said substrate, dark areas on said substrate or combination thereof.

17. The substrate of claim 16, wherein said defect is less than about 20 mm.

18. The substrate of claim 14, wherein said image comprises a TMA of about 0.7 g/cm$^2$.

19. The substrate of claim 14, wherein said image comprises a TMA of greater than about 0.7 g/cm$^2$.

* * * * *